US009658045B2

(12) United States Patent
Kruger

(10) Patent No.: US 9,658,045 B2
(45) Date of Patent: May 23, 2017

(54) BLASTING SYSTEM CONTROL

(71) Applicant: DETNET SOUTH AFRICA (PTY) LTD, Woodmead (ZA)

(72) Inventor: Michiel Jacobus Kruger, Woodmead (ZA)

(73) Assignee: DETNET SOUTH AFRICA (PTY) LTD, Woodmeed (ZA)

( * ) Notice: Subject to any disclaimer, the term of this patent is extended or adjusted under 35 U.S.C. 154(b) by 0 days.

(21) Appl. No.: 15/110,918

(22) PCT Filed: Apr. 8, 2015

(86) PCT No.: PCT/ZA2015/000021
§ 371 (c)(1),
(2) Date: Jul. 11, 2016

(87) PCT Pub. No.: WO2015/168709
PCT Pub. Date: Nov. 5, 2015

(65) Prior Publication Data

US 2017/0030695 A1 Feb. 2, 2017

(30) Foreign Application Priority Data

Apr. 22, 2014 (ZA) ..... 2014/02861

(51) Int. Cl.
*F42D 3/04* (2006.01)
*F42D 1/055* (2006.01)
(Continued)

(52) U.S. Cl.
CPC ..... *F42D 5/00* (2013.01); *F42D 1/045* (2013.01); *F42D 1/055* (2013.01); *F42D 3/04* (2013.01)

(58) Field of Classification Search
CPC .. F42B 1/045; F42B 1/05; F42B 1/055; F42B 3/00; F42B 3/04; F42B 3/06; F42B 5/00
(Continued)

(56) References Cited

U.S. PATENT DOCUMENTS 6,941,870 B2 * 9/2005 McClure ..... F42D 1/055 102/311
7,578,237 B2 * 8/2009 Johnston ..... F42D 3/04 102/200
(Continued)

FOREIGN PATENT DOCUMENTS

WO 2006086843 8/2006
WO 2012149277 11/2012

OTHER PUBLICATIONS

Written Opinion from the International Searching Authority for Application No. PCT/ZA2015/000021 dated Dec. 23, 2015 (5 pages).

*Primary Examiner* — James S Bergin
(74) *Attorney, Agent, or Firm* — Michael Best & Friedrich LLP

(57) ABSTRACT

A method of controlling operation of a blasting system which includes a plurality of detonators (12) which are loaded into respective boreholes (18) and a control device (20) for initiating the detonators (12). The method including the steps of measuring the position of each detonator (12), measuring the position of the control device (20), from these measurements, in respect of each detonator (12), calculating the distance between the control device (20) and the detonator (12), comparing the calculated distance to a minimum distance requirement and of allowing the control device (20) to initiate the detonators (12) only if the respective calculated distance between each detonator (12) and the control device (20) exceeds a minimum distance requirement.

20 Claims, 2 Drawing Sheets

(51) Int. Cl.
*F42D 1/045* (2006.01)
*F42D 5/00* (2006.01)

(58) Field of Classification Search
USPC ..... 102/301, 302, 311, 312, 313, 206, 215, 102/217
See application file for complete search history.

(56) References Cited

U.S. PATENT DOCUMENTS

| | | | | |
|---|---|---|---|---|
| 7,594,471 | B2 | 9/2009 | Koekemoer et al. | |
| 2002/0088620 | A1 | 7/2002 | Lerche et al. | |
| 2005/0103219 | A1 | 5/2005 | McClure et al. | |
| 2006/0027121 | A1 | 2/2006 | Koekemoer et al. | |
| 2014/0026775 | A1* | 1/2014 | Papillon | F42D 1/055 102/215 |
| 2016/0195379 | A1* | 7/2016 | Van Wyk | C06C 7/00 102/215 |
| 2016/0209195 | A1* | 7/2016 | Kruger | F42D 1/055 |
| 2016/0313107 | A1* | 10/2016 | Birkin | F42D 3/04 |

* cited by examiner

BLASTING SYSTEM CONTROL

BACKGROUND OF THE INVENTION

This invention relates to a method of controlling operation of a blasting system.

A blasting system typically includes a plurality of detonators placed in respective boreholes which are filled with explosives. Upon initiation of the detonators rock is fragmented by the explosives. This type of operation is potentially dangerous in that incorrect charging of the boreholes or incorrect drilling thereof can result in the production of fly rock, i.e. rocks which are ejected from a blast face, which can pose a hazard to nearby persons or structures.

Apart from fly rock, pressure waves, fumes and dust are generated by the firing of the detonators. These factors are, in themselves, potentially harmful or can have secondary adverse effects.

In order to address the aforementioned situation a minimum distance should be maintained between detonators in a blasting bench and a location at which firing of the detonators is initiated. Usually procedural techniques are relied upon to ensure that the minimum distance requirement is met. However, a demanding environment can prevail at a blasting site and mistakes can be made, for example, in estimating distances between detonators or between each detonator and a blasting machine.

U.S. Pat. No. 7,594,471 describes a blasting system wherein control equipment is allowed to initiate blasting only if the equipment is at a selected site. However, this document does not disclose a satisfactory solution to the described problem.

An object of the present invention is to address, at least to some extent, the aforementioned situation.

SUMMARY OF THE INVENTION

The invention provides a method of controlling operation of a blasting system which includes a plurality of detonators and a control device for initiating the detonators, the method including the step of allowing the control device to initiate the detonators only if the spacing between each detonator and the control device exceeds a minimum distance requirement.

The method of the invention can be implemented in different ways. In one approach the method includes the steps of measuring the position of each detonator, measuring the position of the control device, from these measurements, in respect of each detonator, calculating the distance between the control device and the detonator, and comparing the calculated distance to the minimum distance requirement. It is only if the calculated distance for each detonator exceeds the minimum distance requirement that the control device is allowed to initiate the detonators, subject to other operational factors.

In implementing this approach the position of each detonator may be measured in an absolute sense, for example, by determining the geographical coordinates of each detonator and, similarly, by determining the geographical coordinates of the control device.

In measuring the absolute position of each detonator, any appropriate device or technique may be employed. For example, in the establishment of the blasting system it is known to make use of one or more taggers or recording devices which are carried by respective operators to successive operating locations e.g. to each borehole at which a detonator is used. Such recording device can carry a GPS or similar location measuring apparatus. Positional data generated by that apparatus may be stored in the recording device and linked to the detonator or its operating location by an identity number which is uniquely associated with the detonator. The data is then transferred to a computing mechanism which, through the use of the positional data which relates to the location of the control device, allows for the precise spacing between the control device and each respective detonator to be calculated.

In a different approach the position of each detonator is measured with respect to a reference location. Preferably the reference location is the location at which the control device is situated. In this form of the invention the absolute position of each detonator is not determined or measured. However, the position of each detonator is established with reference to the reference location. It is not necessary to establish the absolute geographical location of each detonator. In the former method that information is only of use in determining the spacing between the control device and the detonator.

Any appropriate data storage device can be used in the aforementioned manner. For example, positional data may be stored on a removable and mobile storage device such as a USB mass storage device, an RFID tag, a NFC tag, an SD card, a flash memory or the like. These devices are convenient and easy to use and they allow the positional data to be transferred, with ease and in a secure manner, to a computing facility at which the spacing between each detonator and the control device can be calculated.

In a variation of the invention, the positional data of each detonator is not stored in the recording device but, instead, is transferred to the detonator and held by the detonator in an internal memory. The positional data can be retrieved from the detonator by interrogating the detonator e.g. by using a signal from the control device.

If the precise position of each detonator is not measured, in an absolute sense, then the recording device, e.g. tagger referred to, can be employed to make a direct distance measurement between each detonator and the control device. The control device may for example include an appropriate reflector and the recording device may be used to emit a signal when the recording device is positioned at each detonator. The signal is transmitted to the reflector which returns the signal to the recording device. Data derived from the process allows a calculation to be made of the precise distance between the control device and the detonator. This type of measurement technique is known in the art.

The principles of the invention can be used in a detonator system wherein the individual detonators are connected to a control device by means of one or more harnesses, or in a so-called wireless system wherein the control device can communicate in a wireless manner with each detonator and, optionally, each detonator can communicate in a wireless manner with the control device.

In the wireless system a sufficiently accurate and acceptable indication of the spacing between the control device and each detonator can be obtained by measuring, at each detonator, the strength of a signal which is emitted at a controlled and known signal value at the control device. A degree of attenuation of the signal as it travels to each detonator is then a measure of the spacing between the control device and the detonator.

BRIEF DESCRIPTION OF THE DRAWINGS

The invention is further described by way of examples with reference to the accompanying drawings FIGS. 1 and 2 which respectively diagrammatically depict a blasting system, the operation of which is controlled in accordance with the principles of the invention.

DESCRIPTION OF PREFERRED EMBODIMENTS

Figure 1:
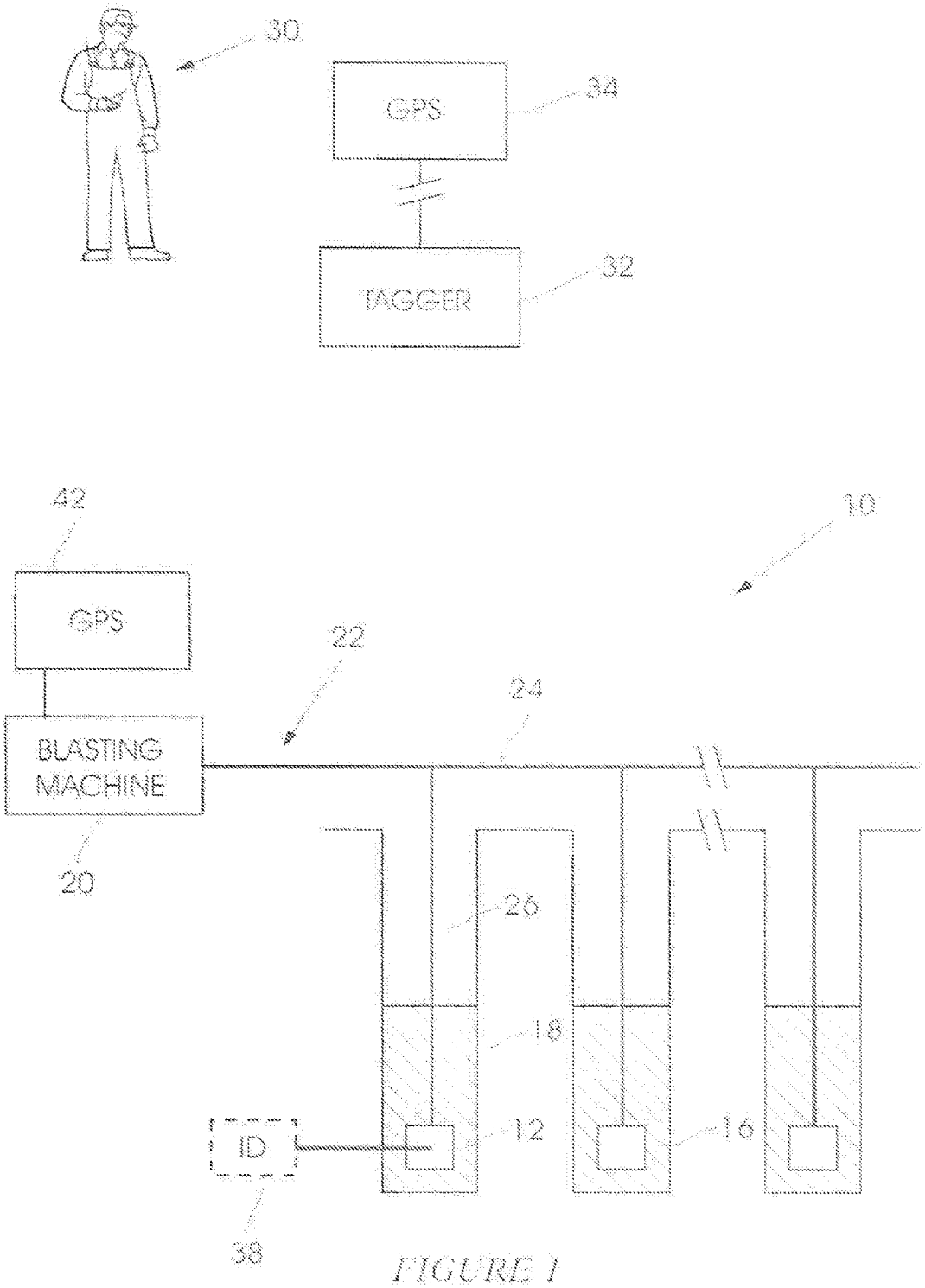

FIG. 1 of the accompanying drawings illustrates a blasting system 10 which includes a plurality of detonators 12 which are respectively loaded, together with explosives 16, into boreholes 18. The detonators are connected to a blasting machine 20 via a harness 22 which includes a main line 24 and a plurality of branch lines 26.

In implementing the method of the invention an operator 30, who may be one of a number of similar operators, carries a recording device 32, typically a tagger/tester. In this example the tagger is associated with a GPS module 34 which, as is known in the art, automatically delivers data which is a precise indication of the geographical location, in an absolute sense, of the tagger.

The operator 30 goes from borehole to borehole and, at each borehole carries out various procedures or steps such as testing, programming and the like, as is known in the art. Additionally, in one form of the invention, the tagger obtains from each respective detonator 12 a unique identity number 38 which is associated with that detonator. The identity number is stored in the tagger together with the positional data relating to the detonator. Once the operator has traversed all or an allotted portion of the blasting system the data held in the tagger is transferred to the blasting machine which, itself, may have a GPS module 42 which delivers positional information which is precisely associated with the geographical position of the blasting machine. Alternatively, the tagger 32 can be brought to the blasting machine so that the GPS module 34 can be used to measure the geographical position of the blasting machine.

In a different form of the invention the positional data for a detonator 12, obtained by the module 34, is transferred to the respective detonator 12. Thereafter, the positional data is recovered from each detonator by using the blasting machine 20 to interrogate each detonator. The positional data is linked to the respective detonator by means of the associated identity number 38.

In each form of the invention the blasting machine can execute a program to determine the distance between the blasting machine and each detonator. In accordance with known safety protocols a calculated distance, for each detonator, must be in excess of a predetermined minimum distance requirement if blasting is to be carried out safely. Thus, unless the spacing, in respect of each detonator, exceeds the minimum distance requirement, the operation of the blasting machine is inhibited so that it cannot be used to initiate the detonators. Under these circumstances corrective action must be taken.

Figure 2:
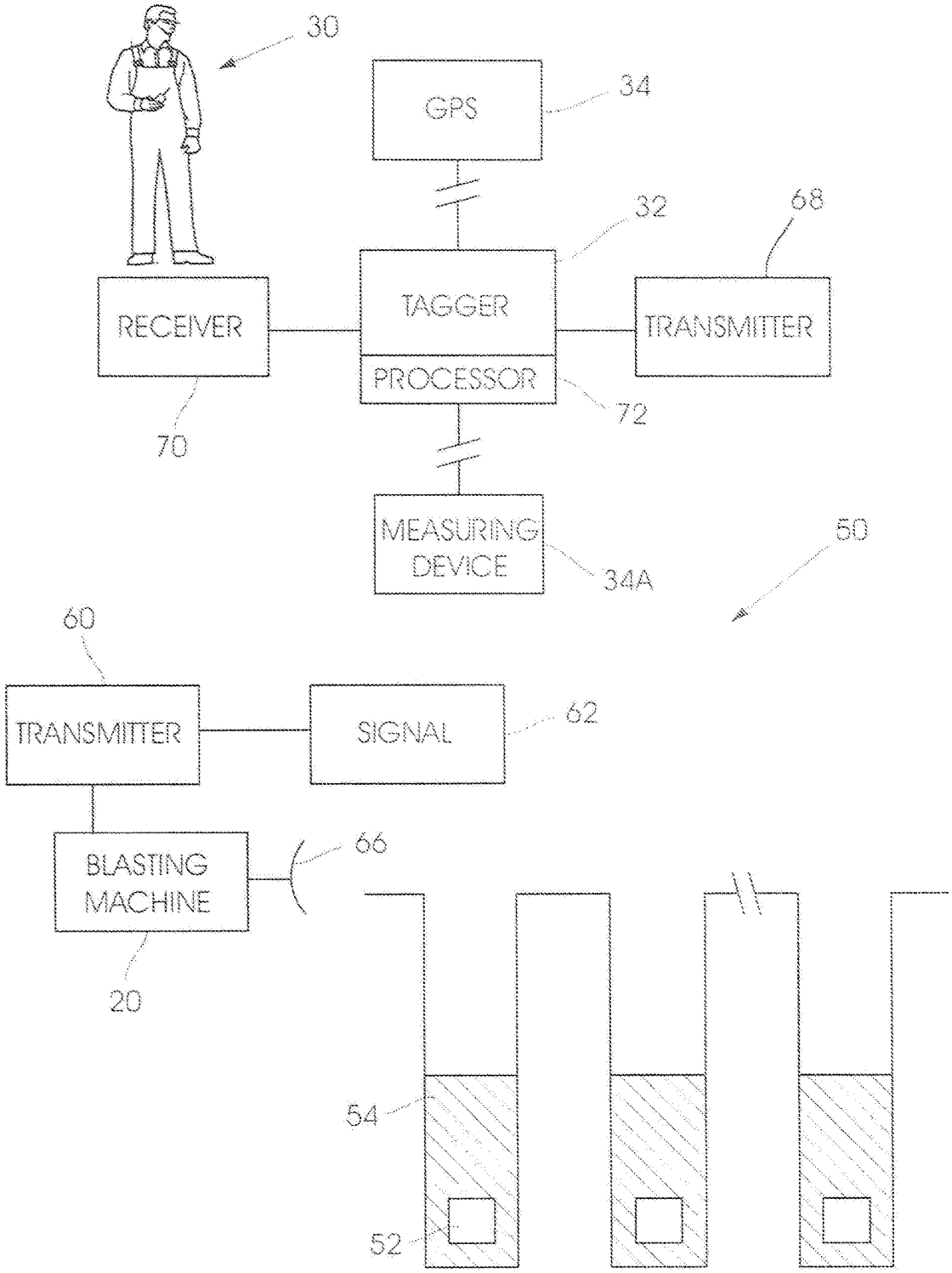

FIG. 2 illustrates a wireless blasting system 50 wherein individual detonators 52 together with explosives 54 are loaded into respective boreholes 56. As is the case with the FIG. 1 embodiment an operator 30 using a tagger 32 and a GPS module 34 executes a testing and programming sequence, in accordance with known requirements and, at the same time, obtains positional data for each detonator. This positional data is subsequently transferred to a calculator, e.g. in the blasting machine 20 which carries out distance calculations, in the manner described. The blasting machine is then only capable of firing the individual detonators if the minimum distance requirement, for each detonator, is exceeded.

If the arrangement is one in which the blasting machine can communicate with the detonators but signals cannot be transferred from each detonator to the blasting machine then it is hot normally feasible to transfer positional data from the GPS module to each detonator.

As an alternative to the use of the module 34 a transmitter 60, located at the blasting machine is used to transmit a signal 62 which, at the transmitter, has a known and controlled strength. The GPS module 34 is then replaced by a measuring device 34A which can measure the strength of the signal 62 at each borehole. The strength of the signal diminishes with distance from the transmitter and is thus inversely related to the spacing between the transmitter and each detonator. This approach eliminates the need for absolute positional data for it effectively automatically provides a direct measurement of the distance between the control device and each detonator. Again, if the minimum distance required for each detonator is not satisfied, blasting is inhibited.

In another technique which can be used with either embodiment, a reflector 66 is positioned at the blasting machine or at an intermediate location. Each operator carries an appropriate transmitter 68 which transmits a signal to the reflector 66. This signal is returned to the operator and detected by a receiver 70. Using techniques which are known in the art a precise calculation, for example by using a processor associated with the tagger, can automatically and immediately be made of the distance between each borehole and the reflector i.e. the control device (or the intermediate location) and, at the time, an indication can be given that the minimum distance requirement is not, or is satisfied.

A variation of this technique, which requires the use of multiple reflectors, is adopted if there is no direct line of sight between the transmitter and each borehole.

The invention claimed is:

1. A method of controlling operation of a blasting system which includes a plurality of detonators (12) which are loaded into respective boreholes (18) and a control device (20) for initiating the detonators (12), the method including the steps of measuring the position of each detonator (12), measuring the position of the control device (20), from these measurements, in respect of each detonator (12), calculating the distance between the control device (20) and the detonator (12), comparing the calculated distance to a minimum distance requirement and of allowing the control device (20) to initiate the detonators (12) only if the respective calculated distance between each detonator (12) and the control device (20) exceeds a minimum distance requirement.

2. A method according to claim 1 wherein positional data of each detonator (12) is derived from an absolute determination of the geographical coordinates of the detonator (12) and of the geographical coordinates of the control device (20).

3. A method according to claim 2 wherein the geographical co-ordinates of each detonator (12) are measured using a location measuring apparatus (34).

4. A method according to claim 3 wherein the positional data for a detonator (12), produced by the location measuring apparatus (34), is linked to the detonator (12) or to its respective borehole (18) by an identity number (38) which is uniquely associated with the detonator (12).

5. A method according to claim 4 wherein the positional data of each detonator (12) is transferred to the detonator (12) and held by the detonator (12) in an internal memory.

6. A method according to claim 5 which includes the step of retrieving the positional data by interrogating the detonator (12).

7. A method according to claim 6 wherein the detonator (12) is interrogated by using a signal from the control device (20).

8. A method according to claim 4 wherein the positional data of each detonator (12) is transferred to a mobile storage device (32).

9. A method according to claim 8 wherein the positional data of each detonator (12) is transferred to the detonator (12) and held by the detonator (12) in an internal memory.

10. A method according to claim 9 which includes the step of retrieving the positional data by interrogating the detonator (12).

11. A method according to claim 10 wherein the detonator (12) is interrogated by using a signal from the control device (20).

12. A method according to claim 1 wherein a respective direct distance measurement between each detonator (12) and the control device (20) is made.

13. A method according to claim 12 wherein, for each detonator (12), the respective direct distance between the control device (20) and the detonator (12) is calculated using data produced by transmitting a signal from the detonator (12) to the control device (20) and then returning the signal from the control device (20) to the detonator (12).

14. A method according to claim 13 wherein the detonators (12) are connected to the control device (20) by means of at least one harness (24, 26).

15. A method according to claim 13 wherein the control device (20) communicates in a wireless manner with each detonator (12).

16. A method according to claim 13 wherein each detonator (12) communicates in a wireless manner with the control device (20).

17. A method according to claim 12 wherein a measurement of the respective distance between the control device (20) and each detonator (12) is obtained by measuring at the detonator (12) the strength of a signal (62) which is emitted at a controlled and known signal value by a transmitter (60) at the control device (20).

18. A method according to claim 1 wherein the detonators (12) are connected to the control device (20) by means of at least one harness (24, 26).

19. A method according to claim 1 wherein the control device (20) communicates in a wireless manner with each detonator (12).

20. A method according to claim 1 wherein each detonator (12) communicates in a wireless manner with the control device (20).

* * * * *